US008481240B2

(12) United States Patent
Chen et al.

(10) Patent No.: US 8,481,240 B2
(45) Date of Patent: Jul. 9, 2013

(54) ELECTROPHOTOGRAPHIC IMAGING MEMBER AND METHOD OF MAKING SAME

(75) Inventors: Cindy C. Chen, Hsin Chu (TW); Lanhui Zhang, Webster, NY (US); Linda L. Ferrarese, Rochester, NY (US); James M. Markovics, Rochester, NY (US); Marc J. LiVecchi, Rochester, NY (US); Edward C. Savage, Webster, NY (US); James R. Backus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/301,933

(22) Filed: Nov. 22, 2011

(65) Prior Publication Data

US 2012/0063818 A1 Mar. 15, 2012

Related U.S. Application Data

(62) Division of application No. 11/800,546, filed on May 7, 2007, now abandoned.

(51) Int. Cl.
*G03G 5/05* (2006.01)

(52) U.S. Cl.
USPC ..... 430/127; 430/59.1; 430/59.4; 430/123.43

(58) Field of Classification Search
USPC ..... 430/59.1, 59.4, 123.43, 127
See application file for complete search history.

(56) References Cited

U.S. PATENT DOCUMENTS

| | | | |
|---|---|---|---|
| 4,960,665 | A | 10/1990 | Elder et al. |
| 5,055,862 | A | 10/1991 | Hansen et al. |
| 5,358,813 | A | 10/1994 | Iijima et al. |
| 5,360,475 | A | 11/1994 | Nukada et al. |
| 5,376,782 | A | 12/1994 | Ikeda et al. |
| 5,418,107 | A | 5/1995 | Nealey et al. |
| 5,449,581 | A | 9/1995 | Matsui et al. |
| 5,521,043 | A | 5/1996 | Listigovers et al. |
| 5,563,261 | A | 10/1996 | Keoshkerian et al. |
| 5,588,991 | A | 12/1996 | Hongo et al. |
| 5,606,395 | A | 2/1997 | Yang et al. |
| 5,606,398 | A | 2/1997 | Ender |
| 5,643,703 | A | 7/1997 | Daimon et al. |
| 5,679,488 | A | 10/1997 | Itami et al. |
| 5,681,678 | A | 10/1997 | Nealey et al. |
| 5,688,619 | A | 11/1997 | Hongo et al. |

(Continued)

FOREIGN PATENT DOCUMENTS

JP 2005-249964 * 9/2005

OTHER PUBLICATIONS

John C. Briggs et al, "Analysis of Ghosting in Electrophotography," Quality Engineering Associates, Inc., Oct. 16-19, 2000.

(Continued)

*Primary Examiner* — Peter Vajda
(74) *Attorney, Agent, or Firm* — Alix, Yale & Ristas, LLP

(57) ABSTRACT

Disclosed herein is an electrophotographic imaging member comprising a substrate, and a charge generating layer containing a phthalocyanine pigment, a binder, and a solvent. The charge generating layer has a pigment particle separation distance of 28 nm or less after evaporation of the solvent. A coating system, a method of making an electrophotographic imaging member, and a method of printing also are disclosed.

18 Claims, 7 Drawing Sheets

U.S. PATENT DOCUMENTS

| | | | | |
|---|---|---|---|---|
| 5,725,985 | A | 3/1998 | Nealey et al. | |
| 5,893,659 | A | 4/1999 | Nanjo et al. | |
| 6,171,747 | B1 | 1/2001 | Sugizaki et al. | |
| 6,379,853 | B1 | 4/2002 | Lin et al. | |
| 6,410,196 | B1 | 6/2002 | Carmichael et al. | |
| 6,492,080 | B1 | 12/2002 | Burt et al. | |
| 6,645,687 | B1 | 11/2003 | Vong et al. | |
| 6,665,510 | B1 | 12/2003 | Hirsch | |
| 6,711,373 | B2 | 3/2004 | Naito | |
| 6,718,150 | B2 | 4/2004 | Matsuduki | |
| 6,773,857 | B2 | 8/2004 | Nakamura et al. | |
| 7,169,920 | B2 | 1/2007 | Lin et al. | |
| 2005/0078987 | A1 | 4/2005 | Nakamura et al. | |
| 2005/0169677 | A1 | 8/2005 | Kaneko | |
| 2005/0238370 | A1 * | 10/2005 | Kameda | 399/35 |
| 2005/0238974 | A1 | 10/2005 | Sekiya et al. | |
| 2005/0282076 | A1 | 12/2005 | Tanaka et al. | |
| 2006/0078811 | A1 | 4/2006 | Nishiyama et al. | |
| 2006/0257768 | A1 | 11/2006 | Chen et al. | |

OTHER PUBLICATIONS

H. Reinius et al, "Mechanical Ghosting—Know the Problem and the Solutions," www.printingnews.com, Nov. 8, 2004, pp. 1-5.

Richard M. Podhajny, Ph.D., "So You've Seen a Ghost! Who You Gonna Call?," www.pffc-online.com, Aug. 1, 2001, pp. 1-2.

Scott Lowe MCSE, "Top 10 HP printing problems and how to fix them," www.techrepublic.com, Sep. 9, 2003, pp. 1-6.

English Translation of Abstract for JP 2005-249964 published Sep. 15, 2005.

* cited by examiner

ELECTROPHOTOGRAPHIC IMAGING MEMBER AND METHOD OF MAKING SAME

This is a divisional of U.S. application Ser. No. 11/800,546 filed May 7, 2007 now abandoned.

BACKGROUND

The embodiments disclosed herein relate to electrophotography and more particularly to electrophotographic imaging members.

It is known to use small pigment particles in making a charge generating layer of an electrophotographic imaging member. Fuji Xerox U.S. Pat. No. 5,358,813 mentions phthalocyanine crystals with a primary grain size of 0.3 μm or less. The examples in Fuji Xerox U.S. Pat. No. 5,688,619 disclose charge generating layers with phthalocyanine pigment particle sizes in the range of 0.14 μm to 0.36 μm.

In xerographic imaging, ghosting is a term used to describe a condition where a faint but visible likeness of the original image appears elsewhere on the same or a subsequent sheet or sheets of media, depending on the producing mechanism. Various techniques have been applied to minimize ghosting correspondingly. Some of these techniques deal with the xerographic hardware such as adding erase lamps or erase corotrons. Certain techniques deal with xerographic process parameters related to component spacing, timing, erase wavelength, or parameter setpoints.

U.S. Pat. No. 5,606,398 is directed to a system and method for reducing residual electrostatic potential and ghosting in a photoconductor. A charge is applied to a surface of a photoconductor, and the photoconductor is exposed to conditioning radiation having wavelengths selected to release charge carriers from trap sites within the photoconductor. Commonly assigned U.S. Pat. No. 6,665,510 describes an apparatus and method for reducing ghosting when developing a latent image recorded on a movable imaging surface by moving the outer surfaces of first and second "donor members" at different velocities. Commonly assigned U.S. Pat. No. 4,960,665 provides that image quality problems such as ghosting can be reduced by selection of a particular toner composition.

It would be useful to develop additional printing techniques and electrophotographic products that minimize or eliminate the appearance of ghosting on electrostatically produced prints or copies.

SUMMARY

One embodiment is an electrophotographic imaging member comprising a substrate and a charge generating layer containing a phthalocyanine pigment, a compatible binder, and a solvent. The charge generating layer has an average pigment particle separation distance of 28 nm or less after evaporation of the solvent.

Another embodiment is a coating system for a charge generating layer of an electrophotographic imaging member. The coating system comprises a dispersion of at least one chlorogallium phthalocyanine pigment in a vinyl resin binder and a solvent in a pigment:binder weight ratio of at least 20:80. The charge generating layer has an average pigment particle separation distance of about 28 nm or less after evaporation of the solvent.

A further embodiment is a method of making an electrophotographic imaging member comprising forming a charge generating layer and a charge transport layer on a substrate. The charge generating layer comprises a phthalocyanine pigment, a binder, and a solvent, and has an average pigment particle separation distance of 28 nm or less after evaporation of the solvent. The electrophotographic imaging member exhibits commercially acceptable ghosting levels when used in an imaging system with a transfer current in the range of 47-52 μA.

A further embodiment is a method of printing. The method comprises providing a printer with an electrophotographic imaging member including a charge generating layer with a pigment to binder ratio in the range of about 20:80 to about 90:10. Toner is applied to the electrophotographic imaging member and is transferred to media using a transfer unit operating at a transfer current including the range of about 47 μA to about 52 μA.

DETAILED DESCRIPTION

Figure 1:
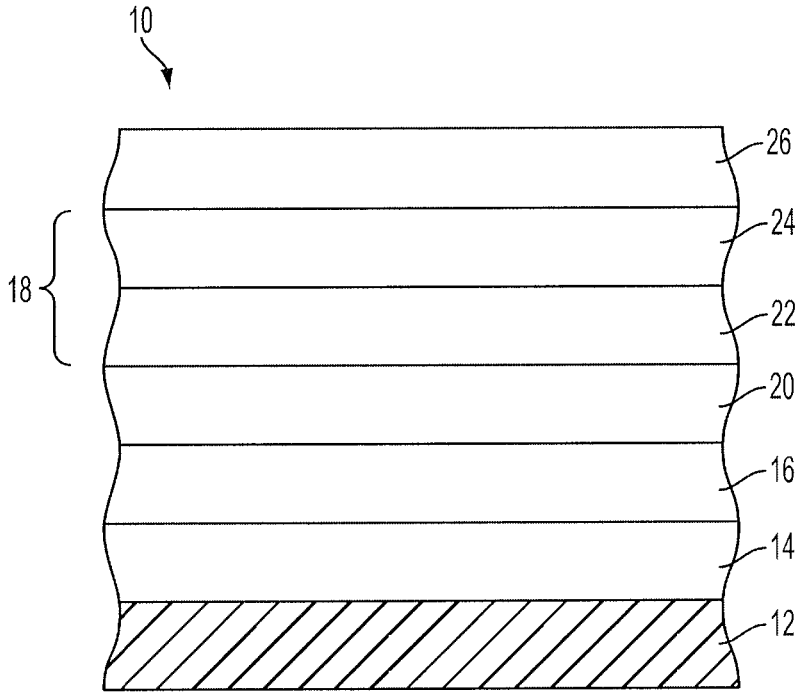
FIG. 1 schematically shows an electrophotographic imaging member having multiple layers.

It has been found that a reduction in print ghosting can be achieved by reducing the pigment particle separation distance in a charge generating layer of an electrophotographic imaging member. A reduced pigment particle separation distance can be obtained by using an increased pigment/binder weight ratio and/or a smaller pigment particle size. The resulting charge generating layer or layers have increased charge mobility, which in turn results in reduced print ghosting. In some cases, the charge mobility is also increased at the interface between the charge generating layer and a charge transport layer, and/or at the interface between the charge generating layer and an undercoat layer.

When a pigment and binder system that is used in an imaging system having a transfer current of, for example, 30-40 μA without causing ghosting problems is employed in an imaging system having a higher transfer current, such as 46-52 μA, ghosting problems will occur if the charge mobility is not high enough to provide for timely movement of a charge out of the electrophotographic imaging member layers. In order to overcome ghosting, it has been found that the pigment particle separation distance can be reduced. This finding enables pigment binder systems that are configured for use with conventional imaging equipment to be adapted for use with new imaging equipment operating at a higher transfer current without increasing the propensity for image ghosting.

Higher transfer currents are generally required for toner transfer to heavy weight media, for operation in wet (A-zone) environment, and for faster process speeds when through-put is increased. Some machines automatically adjust transfer current for changing conditions such as described.

As used herein, "substrate" refers to a base layer of a multilayered electrophotographic imaging member. The term "charge generating layer" refers herein to a layer or set of layers of an electrophotographic imaging member that contain a charge generating material. "Ghosting" as used herein refers to the undesirable production of a shadow or second image near the original image on the same or a subsequent sheet or subsequent sheets of media. A commercially acceptable "ghosting" level as used herein refers to a print ghosting level between −4 and +4 as measured by the ghost fixture test. The sign of the ghost level implies negative or positive image ghosting; its absolute value represents the magnitude; and level zero represents no visible ghosting. "Photosensitivity" as used herein refers to sensitivity to the action of radiant energy. "Charge mobility" is the rate of movement of an electrical charge through a layer of a photoreceptor.

"Average pigment particle separation distance" as used herein refers to the average separation distance of pigment particles that are substantially uniformly dispersed in a binder. Separation distance is from the perimeter of a pigment particle to the perimeter of an adjacent pigment particle. One method to determine an average pigment particle separation distance is by calculating it using Formula 1 below. "Pigment diameter" refers herein to the effective diameter of pigment particles, measured by Dynamic Light Scattering method (DLS), assuming that the pigment particles are spheres.

In this disclosure, "compatible" refers to physical and chemically compatibility of different pigments and binders such the pigments form a uniform dispersion in the binder. As used herein, an electrophotographic imaging member that is "utilized" in an imaging system can be used in commercial production, evaluation and/or testing. The term "printer" as used herein encompasses any apparatus, such as a digital copier, bookmaking machine, facsimile machine, multi-function machine, etc. that performs a print outputting function for any purpose.

Referring to FIG. 1, an electrophotographic imaging member 10 has a flexible or rigid substrate 12 with an electrically conductive surface or coating 14. An optional hole blocking layer 16 may be applied to the surface or coating 14. If used, the hole blocking layer is capable of forming an electronic barrier to holes between an adjacent electrophotographic imaging layer 18 and the underlying surface or coating 14. An optional adhesive layer 20 may be applied to the hole-blocking layer 16.

The one or more electrophotographic imaging layers 18 are formed on the adhesive layer 20, blocking layer 16 or substrate surface or coating 14. Layer 18 may be a single layer that performs both charge generating and charge transport functions, or it may comprise multiple layers such as a charge generating layer 22 and a charge transport layer 24. The charge generating layer 22 can be applied to the electrically conductive surface or coating 14 or can be applied on another surface between the substrate 12 and the charge generating layer 22. Usually the charge generating layer 22 is applied on the blocking layer 16 or the optional adhesive layer 20. The charge transport layer 24 usually is formed on the charge generating layer 22. However, the charge generating layer 22 can be located on top of the charge transport layer 24.

An overcoat 26 usually is applied over the electrophotographic imaging layer 18 to improve the durability of the electrophotographic imaging member 10. The overcoat 26 is designed to provide wear resistance and image deletion resistance to the imaging member while not adversely affecting the chemical and/or physical properties of the underlying layers during the coating process and not adversely affecting the electrical properties of the resulting imaging member. Selection of appropriate components for the overcoat 26 is important in order to achieve these diverse requirements.

The substrate 12 of the imaging member may be flexible or rigid and may comprise any suitable organic or inorganic material having the requisite mechanical and electrical properties. It may be formulated entirely of an electrically conductive material, or it can be an insulating material including inorganic or organic polymeric materials, such as polyester, polyester coated titanium, a layer of an organic or inorganic material having a semiconductive surface layer, such as indium tin oxide, aluminum, aluminum alloys, titanium, titanium alloys, or any electrically conductive or insulating substance other than aluminum, or may be made up of exclusively conductive materials, such as aluminum, semitransparent aluminum, chromium nickel, brass, copper, nickel, chromium, stainless steel, cadmium, silver, gold, zirconium, niobium tantalum, vanadium hafnium, titanium, tungsten, indium, tin, metal oxides, conductive plastics and rubbers, and the like. In embodiments where the substrate layer is not conductive, the surface is rendered electrically conductive by an electrically conductive coating. The coating typically but not necessarily has a thickness of about 20 to about 750 angstroms.

The optional hole blocking layer 16 comprises any suitable organic or inorganic material having the requisite mechanical and electrical properties. The hole blocking layer 16 can be comprised of, for example, polymers such as polyvinylbutyral, epoxy resins, polyesters, polysiloxanes, polyamides, polyurethanes, and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-aminobenzene sulfonate oxyacetate, titanium 4-aminobenzoate isostearate oxyacetate, $[H_2N(CH_2)_4]CH_3Si(OCH_3)_2$, gamma-aminobutyl)methyl diethoxysilane, $[H_2N(CH_2)_3]CH_3Si(OCH_3)_2$, (gamma-aminopropyl)-methyl diethoxysilane, vinyl hydroxyl ester and vinyl hydroxy amide polymers wherein the hydroxyl groups have been partially modified to benzoate and acetate esters that modified polymers are then blended with other unmodified vinyl hydroxy ester and amide unmodified polymers, alkyl acrylamidoglycolate alkyl ether containing polymer, the copolymer poly(methyl acrylamidoglycolate methyl ether-co-2-hydroxyethyl methacrylate), zinc oxide, titanium oxide, silica, polyvinyl butyral, and phenolic resins. The blocking layer often is continuous and usually has a thickness of less than about 25 micrometers, and more specifically, from about 0.5 to about 10 micrometers.

The optional adhesive layer 20 can comprise, for example, polyesters, polyarylates, polyurethanes, copolyester-polycarbonate resin, and the like. The adhesive layer may be of a thickness, for example, from about 0.01 micrometers to about 2 micrometers after drying, and in other embodiments from about 0.03 micrometers to about 1 micrometer.

Figure 2:
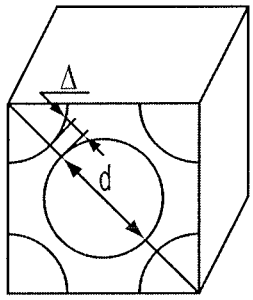
FIG. 2 illustrates particle separation distance A in a charge generating layer.

The charge generating layer 22 contains a charge generating material comprising a pigment that is dispersed in a binder. Assuming that pigment particles are uniformly distributed in a continuous phase binder in a "tightest packing"

mode as spherical particles and that there is no void space, i.e., binder molecules fill up all of the gaps, an average pigment particle separation distance can be calculated as follows:

$$\Delta = \left\{\left[\left(1 + \frac{1 - x_P}{x_P} \cdot \frac{\rho_P}{\rho_B}\right) \cdot \frac{\pi}{3\sqrt{2}}\right]^{1/3} - 1\right\} \cdot d \qquad \text{Formula 1}$$

where $x_P$ is the weight fraction of pigment; $\rho_P$ the density of pigment and $\rho_B$ the density of binder, and d is the average diameter of the pigment particles. As can be seen, reducing the particle size and/or increasing the pigment/binder ratio will reduce the pigment particle separation distance. FIG. 2 illustrates this concept.

Table 1 below provides estimated values of density and particle size for pigment-binder systems that can be used in the charge generating layer of a photoreceptor. Pigment particles separation distances for various pigment weight fractions are calculated using Formula 1.

TABLE 1

| | | Example | | | | | | | |
|---|---|---|---|---|---|---|---|---|---|
| Pigment and Binder properties | | A | B | C | D | E | F | G | H |
| Density of pigment (g/mL): | $\rho_P$ | 1.60 | 1.60 | 1.60 | 1.60 | 1.60 | 1.60 | 1.60 | 1.60 |
| Density of binder (g/mL): | $\rho_B$ | 1.35 | 1.35 | 1.35 | 1.35 | 1.35 | 1.35 | 1.35 | 1.35 |
| Pigment weight fraction: | $x_P$ | 0.52 | 0.52 | 0.52 | 0.52 | 0.52 | 0.52 | 0.52 | 0.52 |
| Pigment particle size (nm): | d | 50 | 100 | 150 | 175 | 200 | 225 | 250 | 300 |
| Interparticle distance (nm): | D | 58 | 116 | 174 | 203 | 231 | 260 | 289 | 347 |
| Particle separation distance (nm): | $\Delta = D - d$ | 8 | 16 | 24 | 28 | 31 | 35 | 39 | 47 |
| Pigment and Binder properties | | I | J | K | L | M | N | O | P |
| Density of pigment (g/mL): | $\rho_P$ | 1.60 | 1.60 | 1.60 | 1.60 | 1.60 | 1.60 | 1.60 | 1.60 |
| Density of binder (g/mL): | $\rho_B$ | 1.35 | 1.35 | 1.35 | 1.35 | 1.35 | 1.35 | 1.35 | 1.35 |
| Pigment weight fraction: | $x_P$ | 0.60 | 0.60 | 0.60 | 0.60 | 0.60 | 0.60 | 0.60 | 0.60 |
| Pigment particle size (nm): | d | 50 | 100 | 150 | 175 | 200 | 225 | 250 | 300 |
| Interparticle distance (nm): | D | 55 | 110 | 165 | 192 | 220 | 247 | 275 | 330 |
| Particle separation distance (nm): | $\Delta = D - d$ | 5 | 10 | 15 | 17 | 20 | 22 | 25 | 30 |

On Table 1, interparticle distance D is the distance from the center of one particle to the center of an adjacent particle. As is shown on Table 1, the particle separation distance can be reduced by increasing the pigment weight fraction, as is evident by comparing examples having the same particle size but different pigment weight fractions, e.g. by comparing Example A with Example I, etc. The particle separation distance also can be reduced by reducing the particle size, as is shown by comparing Examples A-H with one another and by comparing Examples I-P with one another.

Reducing the particle-to-particle separation distance of the pigment particles increases the charge transport efficiency within a charge generating layer and between a charge generating layer and an adjacent layer. In at least some cases, reduction of the particle-to-particle separation distance of the pigment particles also is believed to increase the charge transport efficiency at the interface between the charge generating layer and the undercoat layer and/or at the interface between the charge generating layer and the charge transport layer.

Suitable pigments for use in forming the charge generating layer include but are not limited to phthalocyanine pigments, polycyclic quinone pigments, azo pigments, dibromoanthanthrone, squarylium pigments, quinacridones, dibromo anthanthrone pigments, benzimidazole perylene, perylene pigments, azulenium pigments, substituted 2,4-diamino-triazines, and the like, and combinations and mixtures thereof, dispersed in a film forming polymeric binder. Multi-photogenerating layer compositions may be utilized where a photoconductive layer enhances or reduces the properties of the photogenerating layer. Examples of this type of configuration are described in commonly assigned U.S. Pat. No. 4,415,639, the entire disclosure of which is incorporated herein by reference. Other suitable photogenerating pigments may be utilized, if desired. Commonly assigned U.S. Pat. Nos. 6,645,687 and 6,492,080, the contents of which are incorporated by reference herein in their entirety, describe processes for forming blends of chlorogallium phthalocyanine pigments dispersed in binder. The pigment particles typically have a size of about 50 nm to about 500 nm, or about 100 nm to about 300 nm, or about 150 nm to about 250 nm, measured by DLS. Generally, if two pigments are used in a blend they are combined in a weight ratio of 95:5 to 5:95, or 70:30 to 30:70. If three pigments are combined, each pigment can be used in amount from 1-98%.

The size of pigment particles can be reduced by milling. Commonly assigned U.S. Pat. Nos. 5,358,813 and 5,688,619 provide non-limiting examples of processes for dry grinding chlorogallium phthalocyanine particles to form pigment particles have small particle sizes. Other techniques for reducing particle size include wet grinding (dispersion) such as ball milling, attritor milling, dynomilling, nanomizer, Cavipro, etc.

Suitable binders for use with in the charge generating layer include but are not limited to thermoplastic and thermosetting resins such as polycarbonates, polyesters including poly(ethylene terephthalate), polyurethanes including poly(tetramethylene hexamethylene diurethane), polystyrenes including poly(styrene-co-maleic anhydride), polybutadienes including polybutadiene-graft-poly(methyl acrylate-co-acrylonitrile), polysulfones including poly(1,4-cyclohexane sulfone), polyarylethers including poly(phenylene oxide), polyarylsulfones including poly(phenylene sulfone), polyethersulfones including poly(phenylene oxide-co-phenylene sulfone), polyethylenes including poly(ethylene-co-acrylic acid), polypropylenes, polymethylpentenes, polyphenylene sulfides, polyvinyl acetates, polyvinylbutyrals, polysiloxanes including poly(dimethylsiloxane), polyacrylates including poly(ethyl acrylate), polyvinyl acetals, polyamides including poly(hexamethylene adipamide), polyimides including poly (pyromellitimide), amino resins including poly(vinyl amine), phenylene oxide resins including poly(2,6-dimethyl-1,4-phenylene oxide), terephthalic acid resins, phenoxy resins including poly(hydroxyethers), epoxy resins including poly ([(o-cresyl glycidyl ether)-co-formaldehyde], phenolic resins including poly(4-tert-butylphenol-co-formaldehyde), polystyrene and acrylonitrile copolymers, polyvinylchlorides, polyvinyl alcohols, poly-N-vinylpyrrolidinones, vinyl acetate copolymers, acrylate copolymers, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like, and combinations thereof. These polymers may be block, random, or alternating copolymers.

Suitable binders include terpolymers and tetrapolymers. Non-limiting examples of terpolymers which may be utilized as the binder include the reaction product of vinyl chloride, vinyl acetate and maleic acid. In one embodiment, the terpolymer may be formed from a reaction mixture having from about 80 percent to about 87 percent by weight vinyl chloride, from about 12 percent to about 18 percent by weight vinyl acetate and up to about 2 percent by weight maleic acid, in embodiments from about 0.5 percent to about 2 percent by weight maleic acid, based on the total weight of the reactants for the terpolymer. Additional description of suitable binders can be found in U.S. Patent Publication No. 2006/0257768, the contents of which are incorporated by reference herein in their entirety.

The weight ratio of the pigment to the binder will depend upon the type of pigment and binder being used. For systems of phthalocyanine pigment and vinyl resin binder, the pigment to binder ratio typically, but not necessarily, is from about 20:80 to about 95:5, or about 40:60 to about 80:20, or about 50:50 to about 70:30.

The pigment usually is dispersed in a solvent. Any suitable solvent can be used that dissolves the particular binder that is being used. Typical low boiling solvents include, but are not limited to alkylene halides, alkylketones, alcohols, ethers, esters, and mixtures thereof. Specific examples of suitable solvents include tetrahydrofuran (THF), methylene chloride, acetone, methanol, ethanol, isopropyl alcohol, ethyl acetate, methylethyl ketone, 1,1,1-trichloroethane, 1,1,2-trichlororethane, chloroform, 1,2-dichloroethane and combinations thereof. Suitable high boiling point solvents which can be used in combination with each other or in combination with low boiling solvents include alkylene halides, alkylketones, alcohols, ethers, esters, aromatics and mixtures thereof. Specific examples of suitable solvents include n-butyl acetate (NBA), methyl isobutyl ketone (MIBK), cyclohexanone, toluene, xylene, monochlorobenzene, dichlorobenzene, 1,2,4 trichlorobenzene, mixtures of one or more of the foregoing solvents, and the like. Some solvents that are particularly useful in combination with ClGaPc pigments and a carboxyl-modified chloride/vinyl acetate copolymer binder are xylene and n-butyl acetate.

Any suitable technique can be used to disperse the pigment particles in the film forming binder. Typical dispersion techniques include, for example, ball milling, roll milling, milling in vertical attritors, sand milling, dynomill milling, Cavipro milling, nanomizer milling, and the like. When blends of pigments are used, the pigment particles can be combined prior to dispersing in the binder solution or separately dispersed in a binder solution and the resulting dispersions combined in the desired proportions for coating application. Blending of the dispersions may be accomplished by any suitable technique. Furthermore, a separate concentrated mixture of each type of pigment particle and binder solution may be initially milled and thereafter combined and diluted with additional binder solution for coating mixture preparation purposes.

Any suitable technique may be utilized to apply the charge generating layer to the substrate. Typical coating techniques include dip coating, roll coating, spray coating, blade coating, wire bar coating, bead coating, curtain coating, rotary atomizers, slot coating, die coating, and the like. The coating techniques may use a wide concentration of solids. As used herein, "solids" refers to the pigment particle and binder components of the coating dispersion.

Drying of the deposited coating may be effected by any suitable conventional technique such as oven drying, infra red radiation drying, air drying and the like.

If the charge generating layer is formed separately from the charge transport layer, the dried charge generating layer typically, but not necessarily, has a thickness in the range of 0.05 to about 5 microns, or about 0.1 to about 2 microns, or about 0.15 to about 1 micron, although the thickness can be outside these ranges.

Known overcoats for imaging members are formed from hydrolyzed silica gel, crosslinked silicone or polyamides. Typical coatings are thin, usually less than 10 microns and typically 2 to 5 microns, in order to provide some degree of improvement in mechanical properties without substantially reducing the electrical properties of the charge transport layer. Any suitable technique may be used to mix and thereafter apply the overcoat layer coating mixture to the underlying layer. Typical application techniques include spraying, dip coating, roll coating, wire wound rod coating, slot coating, die coating, and the like. Drying of the deposited coating may be effected by any suitable conventional technique such as oven drying, infrared radiation drying, air-drying, and the like. The dried overcoating of this invention should transport holes during imaging and should not have too high a free carrier concentration. Free carrier concentration in the overcoat increases the dark decay.

The following examples show certain embodiments and are intended to be illustrative only. The materials, conditions, process parameters and the like recited herein are not intended to be limiting.

Example 1

Electrophotographic imaging member devices were prepared by dip coating aluminum substrates (30×404 mm, rough lathed) with a 1.15 μm undercoat (UC) layer, a charge generating (CG) layer and a charge transport (CT) layer sequentially. The undercoat layer was of a 3-component type and had a final thickness of about 1 micron. The charge generating layer was a ClGaPc Type B pigment/vinyl resin/xylene/n-butyl acetate dispersion in which the weight ratio of ClGaPc Type B pigment to vinyl resin binder (UCAR™ VMCH, Dow Chemical) was 60/40 (device a) or 52/48 (device b). For device a, the weight ratio of xylene to n-butyl acetate was 60/40. For device b, the weight ratio of xylene to n-butyl acetate was 67/33. The charge generating layer had an estimated thickness of about 0.2-0.3 microns. The charge transport layer was formed from a charge transport mixture of polytetrafluoroethylene, N,N'-diphenyl-N,N'-bis(alkylphenyl)-1,1-biphenyl-4,4'-diamine (mTBD) and polycarbonate resin (PCZ400 from Mitsubishi Chemical Co.) in a solvent mixture of tetrahydrofuran and toluene. A small amount of fluorinated surfactant GF300 was used to stabilize PTFE particles. The charge transport layer was applied in a single dip coating and was dried at 120 Deg. C. for 40 minutes. The charge transport layer had a dried thickness of 29 microns.

Using Formula 1 shown above, the pigment particle separation distance was calculated to be 23 nm for device a and 30 nm for device b.

Figure 3:
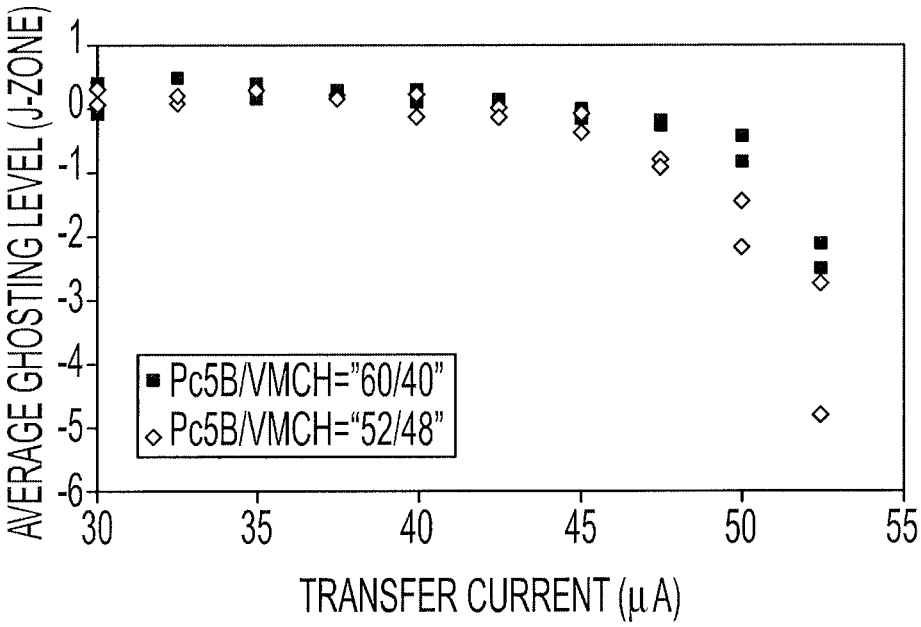
FIG. 3 is a graph showing the average ghosting level (J-zone) at various transfer currents for photoreceptors having charge generating layers containing ClGaPc Type B pigment at different pigment-binder ratios.

FIG. 3 shows the results of a ghosting test referred to herein as the Ghost Fixture Test (GFT). Instead of running large amount of prints under the usual conditions, the print test was conducted in an accelerated mode. As such, the amount of current fed to the machine's first bias transfer roll was well controlled to a series of given values, starting from the nominal power setting for machine (26 μA) and then gradually increasing up to 52.5 μA. The bias transfer roll was located in the intermediate transfer belt (ITB) assembly and contacts the back side of the ITB to supply a positive charge to promote transfer of toner from the photoreceptor drum to the ITB. By increasing the transfer current, the electrophotographic imaging member was tested for ghosting performance under a high stress field condition and therefore only minimal prints were needed. At each level of transfer current, a predefined ghosting document was printed and then analyzed by an IQFA (Image Quality Analysis Facility) image analysis system or visually compared with a template to determine the ghosting level.

Figure 4:
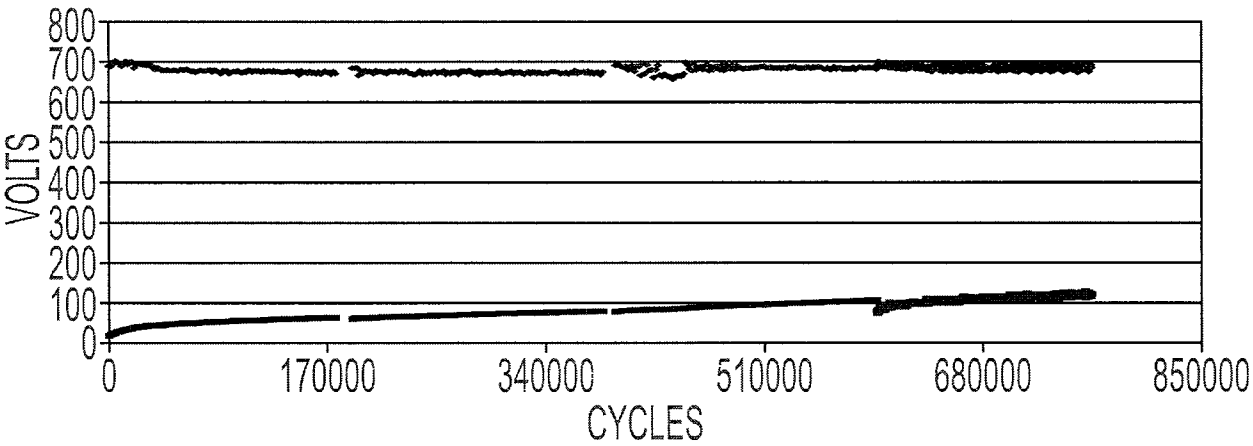
FIG. 4 is a graph showing HMT cycling performance (A-zone) of photoreceptors with a 60:40 pigment to binder weight ratio.

As is shown in FIG. 3, the Ghost Fixture Test indicated that the device with a higher P/B weight ratio, device a, had reduced transfer current induced ghosting in the most stressed condition, J-zone (70 F, 10% R.H.). FIG. 4 shows that device a, with ClGaPc Type B/vinyl resin binder in a weight ratio of 60/40, possessed good cycling performance in the A-zone (83 F, 85% R.H.) HMT tests (Hyper Mode Test of charge and erase cycling), which is essentially equivalent to the device b. In the figure, the upper line on the graph represents $V_{high}$ and the lower line represents $V_{residual}$. Both of these values were stable over the entire cycle test period. The ghosting test was conducted at a machine speed of 194 mm/s and resulted in a ghosting level of −2 at 600,000 cycles. The background printing test was run at 52 mm/s and had a value of 1 at the start of the test. The charge deficient spot (CDS) test was run at 52 mm/s and had a value of 0 at the start of the test. No print plywood phenomena were observed.

Figure 5:
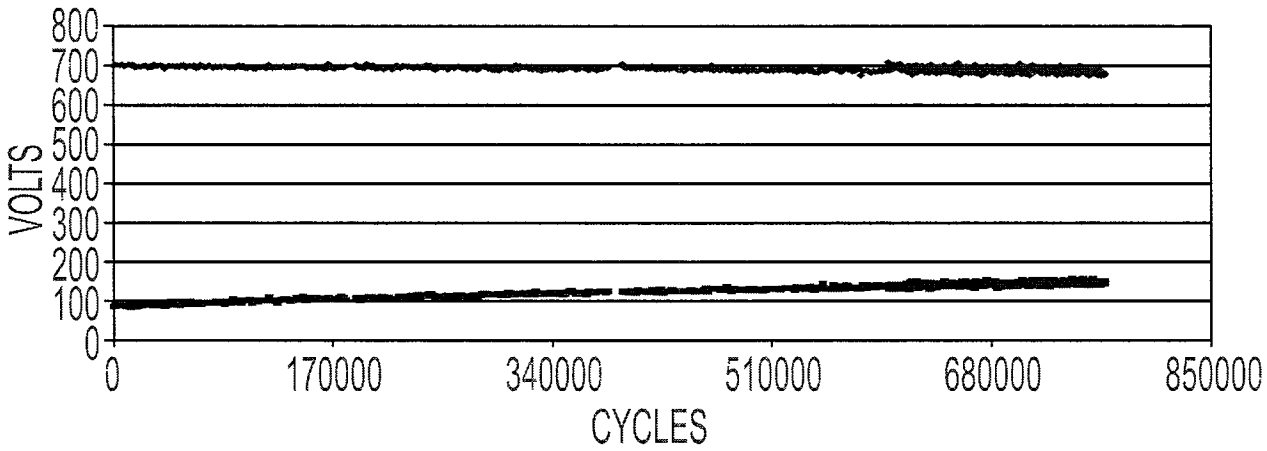
FIG. 5 is a graph showing HMT cycling performance (J-zone) of photoreceptors with a 60:40 pigment binder weight ratio.

FIG. 5 shows that device a also had good cycling performance in the J-zone HMT tests. In FIG. 5, the upper line on the graph represents $V_{high}$ and the lower line represents $V_{residual}$. Both of these values were stable over the entire cycle test period. The ghosting test was conducted at a machine speed of 194 mm/s and resulted in a ghosting level of −3.5 at 600,000 cycles. The results of the background printing and CDS tests were the same as those in the A-zone. No print plywood phenomena were observed.

Example 2

Figure 6:
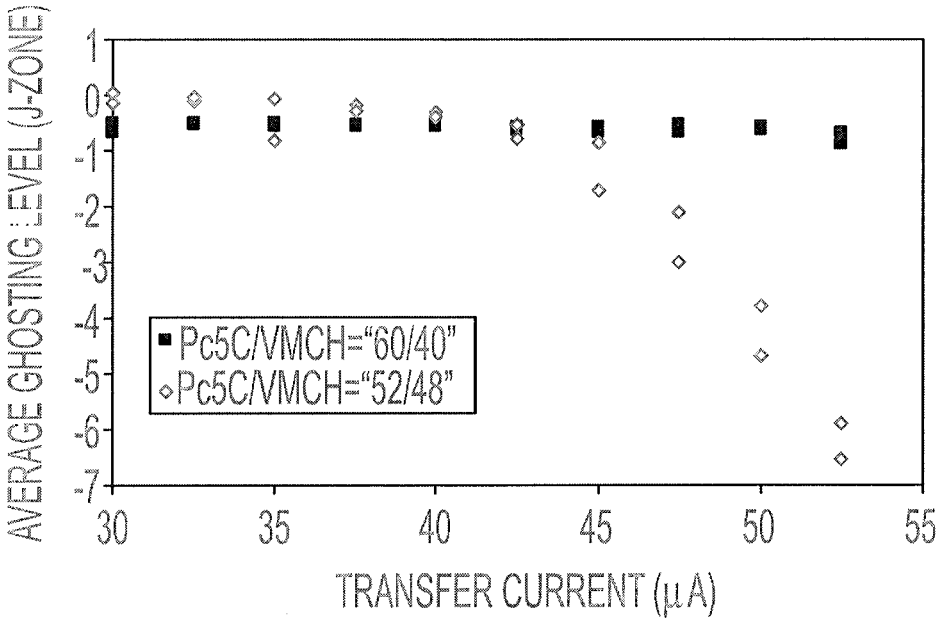
FIG. 6 is a graph showing the average ghosting level (J-zone) at various transfer currents for photoreceptors having charge generating layers containing ClGaPc Type C pigment at several different pigment to binder weight ratios.

Photoreceptor devices were coated as in Example 1 except that ClGaPc Type C was used in place of ClGaPc Type B. FIG. 6 shows GFT/IQFT test results, indicating that the device with a higher pigment to binder ratio has lower transfer current induced ghosting in the most stressed condition, J-zone than the device with a lower pigment to binder ratio.

Example 3

Photoreceptor devices were coated as in Example 1 except using different dispersions for the charge generating layer as described below:

(3-1) ClGaPc Type C/VMCH="60/40", 180 mm/min, RSI=0.023: ClGaPc Type C/VMCH/NBA/xylene CG dispersion, NBA/xylene=50/50, 7.5% solid.

(3-2) ClGaPc Type C/VMCH="60/40", 160 mm/min, RSI=0.023: ClGaPc Type C/VMCH/NBA/xylene CG dispersion, NBA/xylene=50/50, 7.5% solid.

(3-3) ClGaPc Type C/VMCH="60/40", 180 mm/min, RSI=0.035 (The same as in Example 2 as control 3): ClGaPc Type C/VMCH/NBA/xyle CG dispersion, NBA/xylene=60/40, 7.5% solid.

(3-C1) ClGaPc Type B/VMCH="52/48", 180 mm/min, RSI=0.022: ClGaPc Type B/VMCH/NBA/xylene CG dispersion, NBA/xylene=67/33, 6.2% solid [control 1].

(3-C2) ClGaPc Type C/VMCH="52/48", 130 mm/min, RSI=0.030: ClGaPc Type C/VMCH/NBA/xylene CG dispersion, NBA/xylene=67/33, 6.2% solid [control 2].

Figure 7:
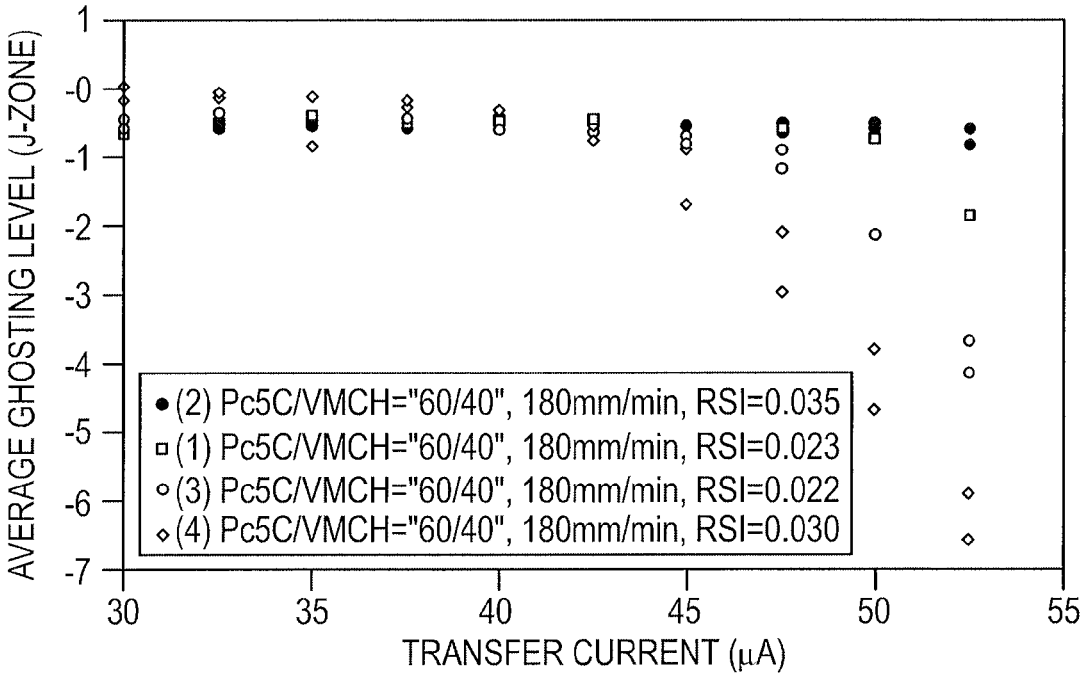
FIG. 7 is a graph showing the average ghosting level (J-zone) at various transfer currents for photoreceptors having charge generating layers containing ClGaPc Type B or ClGaPc Type C pigment at several different pigment to binder weight ratios.

The GFT/IQAF test results obtained in the lab are shown in FIG. 7. It is evident from FIG. 7 that the device with a high pigment/binder ratio has reduced transfer current ghosting in the stressed condition, J-zone.

Initial print tests were conducted and ghosting measurements were made with the initial print, along with a repeated print and ghosting measurement after 500 prints. The device with the high pigment to binder ratio of 60:40 has reduced ghosting in both stressed conditions J-zone and A-zone. The test results are shown below on Table 2.

TABLE 2

Print test evaluation results in A-Zone and J-Zone

| Charge Generating Layer Dispersions | Ratio of NBA: | Particle Size (nm) | Δ (nm) | Testing Zone | Ghosting Level (EvalPt = 0) | Ghosting Level (EvalPt = 500) |
|---|---|---|---|---|---|---|
| 3-1 ClGaPc Type C/VMCH = 60/40 180 mm/min, RSI = 0.023 | 1:1 | 196 | 19 | J | −1 (Sample1)<br>−2 (Sample2) | −4 (Sample1)<br>−4 (Sample2) |
| 3-3 ClGaPc Type C/VMCH = 60/40 180 mm/min, RSI = 0.035 | 1.5:1 | 234 | 23 | J | −1 (Sample1)<br>−1 (Sample2) | −3 (Sample1)<br>−3.5 (Sample2) |
| 3-C1 ClGaPc Type B/VMCH = 52/48 (Control) | 2:1 | 193 | 30 | J | −3 | −5.5 |

TABLE 2-continued

Print test evaluation results in A-Zone and J-Zone

| Charge Generating Layer Dispersions | Ratio of NBA: | Particle Size (nm) | Δ (nm) | Testing Zone | Ghosting Level (EvalPt = 0) | Ghosting Level (EvalPt = 500) |
|---|---|---|---|---|---|---|
| 180 mm/min, RSI = 0.022 | | | | | | |
| 3-2 ClGaPc Type C/VMCH = 60/40 | 1:1 | 234 | 23 | A | −3.5 | −4 |
| 160 mm/min, RSI = 0.023 | | | | | | |
| 3-C1 ClGaPc Type B/VMCH = 52/48 (Control) | 2:1 | 193 | 30 | A | −4.5 | −5 |
| 180 mm/min, RSI = 0.022 | | | | | | |

As shown by the results in Table 2, the initial ghosting level and the ghosting level after 500 prints was lower for the photoreceptor with charge generating layers formed from dispersions with a 60/40 pigment binder ratio than for those with a lower pigment to binder ratio of 52/48. According to the ghosting rating system used herein, a ghosting level between +4 and −4 in both the J and A zones is acceptable. As is shown in FIG. 7, in Example 3-1, the average ghosting level (J-Zone) is no worse than −2 throughout the testing range of 30 to 52.5 μA.

Relative scattering index (RSI) is indicative of particle size. Measurements were made at the beginning of the test period and again several days later. The RSI values did not change between the first and second times they were measured. The particle sizes of Examples 3-1 and 3-2 were both sufficiently small that an acceptable level of ghosting was obtained in the A-Zone. Example 3-1 was also tested in the J-Zone and was found to exhibit acceptable levels of ghosting. No further improvement in ghosting resulted from the lower particle size of Example 3-1 as compared to 3-2.

The disclosed embodiments provide for prolonged use of a printer operated at a regular transfer current before ghosting levels become unacceptable. Furthermore, the embodiments provide for acceptable levels of ghosting when a printer is operated at a high transfer current, including a transfer current in the range of 47-52 μA.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method of making an electrophotographic imaging member comprising:

obtaining a substrate for the electrophotographic imaging member, selecting a phthalocyanine pigment, a binder and a solvent for a charge generating layer, calculating pigment and binder concentrations to be used for the charge generating layer using the following formula:

$$\Delta = \left\{\left[\left(1 + \frac{1 - x_P}{x_P} \cdot \frac{\rho_P}{\rho_B}\right) \cdot \frac{\pi}{3\sqrt{2}}\right]^{\frac{1}{3}} - 1\right\} \cdot d$$

wherein Δ is the average pigment particle separation distance and is 28 nm or less, $x_P$ is the weight fraction of pigment, $\rho_P$ the density of pigment, $\rho_B$ the density of binder, and d is the average diameter of the pigment particles, and forming the charge generating layer and a charge transport layer on the substrate.

2. The method of claim 1, wherein the pigment to binder weight ratio is in the range of about 20:80 to about 90:10.

3. The method of claim 1, wherein the pigment comprises a chlorogallium phthalocyanine.

4. The method of claim 1, wherein the pigment particle separation distance is obtained by using at least one pigment with a small particle size and a pigment to binder ratio of at least 40:60.

5. A method of printing, comprising:

obtaining a substrate for an electrophotographic imaging member, selecting a phthalocyanine pigment, a binder and a solvent for use in forming a charge generating layer for the electrophotographic imaging member, calculating pigment and binder concentrations to be used for the charge generating layer using the following formula:

$$\Delta = \left\{\left[\left(1 + \frac{1 - x_P}{x_P} \cdot \frac{\rho_P}{\rho_B}\right) \cdot \frac{\pi}{3\sqrt{2}}\right]^{\frac{1}{3}} - 1\right\} \cdot d$$

wherein Δ is the average pigment particle separation distance and is 28 nm or less, $x_P$ is the weight fraction of pigment, $\rho_P$ the density of pigment, $\rho_B$ the density of binder, and d is the average diameter of the pigment particles, forming the electrophotographic imaging member, disposing the electrophotographic imaging member in a printer, applying toner to the electrophotographic imaging member, and transferring the toner to media using a transfer unit utilizing a transfer current including the range of about 47 μA to about 52 μA.

6. The method of claim 5, wherein print images produced therefrom have commercially acceptable ghosting levels.

7. The method of claim 1, wherein the pigment has an average particle size in the range of about 50 to 500 nm and the pigment to binder weight ratio is at least 20:80.

8. The method of claim 1, wherein the pigment has an average particle size in the range of about 100 to 300 nm and the pigment to binder weight ratio is at least 40:60.

9. The method of claim 1, wherein the average pigment particle separation distance is no more than about 25 nm.

10. The method of claim 1, wherein the pigment is gallium phthalocyanine.

11. The method of claim 1, wherein the binder is a vinyl resin.

12. The method of claim 5, wherein the pigment has an average particle size in the range of about 50 to 500 nm and the pigment to binder weight ratio is at least 20:80.

13. The method of claim 5, wherein the pigment has an average particle size in the range of about 100 to 300 nm and the pigment to binder weight ratio is at least 40:60.

14. The method of claim 5, wherein the average pigment particle separation distance is no more than about 25 nm.

15. The method of claim 5, wherein the pigment is gallium phthalocyanine.

16. The method of claim 15, wherein the binder is a vinyl resin.

17. The method of claim 9, wherein the pigment is chlorogallium phthalocyanine.

18. The method of claim 1, wherein the pigment consists essentially of chlorogallium phthalocyanine.

* * * * *